US009181784B2

(12) United States Patent
Barbosa Alves et al.

(10) Patent No.: US 9,181,784 B2
(45) Date of Patent: Nov. 10, 2015

(54) METHOD AND APPARATUS FOR LOGGING A WELL BELOW A SUBMERSIBLE PUMP DEPLOYED ON COILED TUBING

(75) Inventors: Bruno Barbosa Alves, Minas Gerais (BR); Hisham Abou El Azm, Paris (FR)

(73) Assignee: Schlumberger Technology Corporation, Cambridge, MA (US)

( * ) Notice: Subject to any disclaimer, the term of this patent is extended or adjusted under 35 U.S.C. 154(b) by 199 days.

(21) Appl. No.: 12/542,470

(22) Filed: Aug. 17, 2009

(65) Prior Publication Data

US 2011/0036568 A1 Feb. 17, 2011

(51) Int. Cl.

| | |
|---|---|
| ***E21B 43/12*** | (2006.01) |
| ***E21B 17/10*** | (2006.01) |
| ***E21B 17/20*** | (2006.01) |
| ***E21B 33/072*** | (2006.01) |
| ***E21B 49/08*** | (2006.01) |
| ***F04D 13/10*** | (2006.01) |
| ***F04D 15/00*** | (2006.01) |

(52) U.S. Cl.

CPC ..... *E21B 43/128* (2013.01); *E21B 17/10* (2013.01); *E21B 17/206* (2013.01); *E21B 33/072* (2013.01); *E21B 49/08* (2013.01); *F04D 13/10* (2013.01); *F04D 15/0088* (2013.01)

(58) Field of Classification Search

USPC ..... 166/250.01, 65.1, 254.2; 417/423.3

See application file for complete search history.

(56) References Cited

U.S. PATENT DOCUMENTS

| | | | | |
|---|---|---|---|---|
| 3,800,871 | A * | 4/1974 | Watson | 166/254.2 |
| 4,509,598 | A * | 4/1985 | Earl et al. | 166/308.2 |
| 4,898,244 | A * | 2/1990 | Schneider et al. | 166/297 |
| 4,926,940 | A * | 5/1990 | Stromswold | 166/247 |
| 5,099,919 | A * | 3/1992 | Schneider et al. | 166/188 |
| 5,186,048 | A | 2/1993 | Foster et al. | |
| 5,435,395 | A * | 7/1995 | Connell | 166/384 |
| 5,803,170 | A * | 9/1998 | Garcia-Soule et al. | 166/242.3 |
| 6,776,233 | B2 * | 8/2004 | Meehan | 166/250.01 |
| 6,962,197 | B2 * | 11/2005 | Khomynets | 166/254.2 |
| 7,004,020 | B2 * | 2/2006 | Schrenkel et al. | 73/152.18 |
| 7,090,011 | B2 * | 8/2006 | Khomynets et al. | 166/254.2 |

(Continued)

FOREIGN PATENT DOCUMENTS

| | | | |
|---|---|---|---|
| GB | 2383357 | A | 6/2003 |

*Primary Examiner* — Jennifer H Gay

*Assistant Examiner* — Caroline Butcher

(74) *Attorney, Agent, or Firm* — Michael L. Flynn; Timothy Curington; Robin Nava

(57) ABSTRACT

An apparatus for characterizing well effluents comprises coiled tubing, an artificial lift mechanism attached to the coiled tubing and a logging tool fitted with sensors capable of characterizing well effluents associated with operation of the artificial lift mechanism. Also a method for characterizing well effluents that includes lowering a logging tool fitted with a multitude of sensors capable of characterizing well effluents with a cable and lowering an artificial lift mechanism on coiled tubing capable of flowing well effluent past the logging tool. Further a method for treating a well including characterizing well effluents by lowering a logging tool fitted with a multitude of sensors capable of characterizing well effluents on a cable and lowering an artificial lift mechanism on coiled tubing capable of flowing well effluent past the logging tool; and injecting a treatment into a desired formation selected using information obtained while characterizing the well effluents.

23 Claims, 5 Drawing Sheets

(56) References Cited

U.S. PATENT DOCUMENTS

| | | | | |
|---|---|---|---|---|
| 7,152,683 | B2 * | 12/2006 | Khomynets | 166/372 |
| 7,234,520 | B2 * | 6/2007 | Khomynets et al. | 166/250.01 |
| 7,409,989 | B2 * | 8/2008 | Khomynets | 166/250.01 |
| 7,455,107 | B2 * | 11/2008 | Khomynets | 166/250.01 |
| 7,686,078 | B2 * | 3/2010 | Khomynets | 166/254.2 |
| 7,806,174 | B2 * | 10/2010 | Khomynets | 166/68 |
| 7,926,563 | B2 * | 4/2011 | Khomynets | 166/252.1 |
| 2006/0225882 | A1 * | 10/2006 | Edwards | 166/254.2 |
| 2007/0036977 | A1 * | 2/2007 | Sinclair et al. | 428/403 |
| 2008/0066908 | A1 * | 3/2008 | Oddie | 166/264 |
| 2008/0134774 | A1 * | 6/2008 | Oddie | 73/152.01 |
| 2010/0147513 | A1 * | 6/2010 | Khomynets | 166/254.2 |

* cited by examiner

METHOD AND APPARATUS FOR LOGGING A WELL BELOW A SUBMERSIBLE PUMP DEPLOYED ON COILED TUBING

FIELD OF DISCLOSURE

The present application is generally related to a method and apparatus for measuring fluid properties via a conventional wireline logging tool below a submersible pump deployed on coiled tubing, and more particularly to methods and apparatus associated with the surface and downhole operations required to achieve wireline logging measurements of fluid properties in reservoirs that need the assistance of a submersible pump in order to flow. In this case, the submersible pump is deployed on coiled tubing. Novel methods and systems to achieve measurements below a submersible pump deployed in coiled tubing as required will be discussed in the present disclosure by ways of several examples that are meant to illustrate the central idea and not to restrict in any way the disclosure.

BACKGROUND OF DISCLOSURE

A typical well has a metal lining called a casing that extends throughout several subsurface formation strata; each formation may contain different fluids such as water, gas, oil or a mixture thereof. The aim of the casing is to isolate the different formations and their fluids. To produce only the desired effluents, the casing is perforated at the depth the formation contains the desired fluids and the other zones are left unperforated to prevent unwanted fluids at other depths from flowing into the casing. The effluents are removed from the well through the use of a second pipe lowered inside the casing called production tubing by either the inherent pressure of the fluid in the formation or by the use of artificial lift mechanisms if the formation pressure is not sufficient to lift the well's effluents on its own. Typically the produced effluents are a mix of fluids such as oil, gas and water. Depending on the percentage of each type of effluent, the well will perform as expected or not. A high water production might produce sufficient hydrostatic pressure in the wellbore to counteract the formation pressure and therefore not allow the effluents to reach the surface on its own. A production facility may not be equipped to handle high production rates of gas. Most wells, at a given point of their life need to be evaluated to correct problems with the well's equipment, low production or excess of unwanted effluents.

To evaluate hydrocarbon or water well production, the industry regularly relies on what are commonly known as logging tools. Depending on the information required, these logging tools might also be called production logging tools. Such tools have packaged sensors to characterize formation and fluid properties. The logging tools are typically lowered into the wellbore via a cable through the well's production tubing. Alternatively the production logging tools can be lowered via slick line (a cable with no conductors), coiled tubing, production tubing or similar means. The reason for using production logging tools in a well are varied and common throughout the life of a well: to investigate water entry, a reduction of production rates, gas entry, paraffin production, casing collapse, commingled production, thief zones, bad cementing, perforating efficiency and many others. The use of production logging tools is the cheapest, widest used and most convenient way to evaluate possible current or future problems in the life of a producing well but there is one condition needed: the well has to be flowing at a minimum volume of effluents in order to evaluate it.

Typically wells logged with these production logging tools are capable of flowing by themselves by initially lowering the hydrostatic column but inevitably the producing formation will deplete as hydrocarbon, gas or water is produced so the pressure from the formation will eventually not be enough to push the effluents to the surface without help. Increasingly a vast number of producing wells are depleting to the point the hydrocarbon needs to be extracted by other means generally called artificial lift mechanisms. Such artificial lift mechanisms include gas lift, electrical submersible pumps (ESPs), downhole pumps, swabbing, "pumping jacks" and numerous other mechanisms which a person skilled in the art will have no problem recognizing. Some estimates widely used in the industry indicates 70% of the world's producing oil fields are in a depletion stage known as "brown fields" needing one or another artificial lift mechanism to produce as the formation pressure is insufficient to lift the effluents to surface at economical rates.

One of the preferred methods for artificially lifting effluents to the surface in these depleted or low rate producing wells is to use a downhole pump. These pumps are generally electrically driven by lowering a power cable from surface to the pump located at the lower end of the production tubing. The design of such pumps do not allow any logging tools to go through it and therefore making it impossible to evaluate the well without retrieving the downhole pump. With the downhole pump in place, the well may produce at the rate required to collect meaningful production logging information but there is not a physical path to lower the production logging tools to the producing formation in order to evaluate it. On the other hand if the downhole pump is retrieved from downhole to allow the production tools to reach the formation needing to be evaluated, then the lack of a downhole pump prevents the producing well from producing the minimum production of effluents needed to evaluate it.

The industry has tried for a long time to find ways to characterize the formation and produced fluids from this type of depleted wells. One such attempt is described in U.S. Pat. No. 5,186,048 dated Feb. 16, 1993, entitled "Method and apparatus for logging a well below a downhole pump" issued to Brian Foster et al., where the inventors propose the use of a production logging tool below a downhole pump with all the equipment needed lowered via production tubing. The method described in the above mentioned patent requires the production logging tools to be lowered into the wellbore to a predetermined depth, then the wireline cable used for lowering and communicating with the production logging tools is cut and fed through a series of adapters designed to pass the wireline cable from the outside of the production tubing to the inside of the production tubing; as each of the joints of production tubing are lowered into the borehole the wireline cable is attached at surface to support the production logging tool, the production logging tool remains at the same depth as the joints of production tubing are lowered one by one; the cable is disconnected every time a new joint is fed at surface, the surface side of the cable is then passed through the new production tubing joint and re-attached to the downhole end of the wireline cable; once the bottom of the production tubing reaches the production logging tool, the tools is "housed" in a protecting sleeve while the well head equipment (blowout preventor, pressure gear, etc.) is rigged up at the surface to be able to flow the well safely. After the safety equipment is rigged up, the downhole pump is started so the well starts producing and the production logging tools are freed from the protective sleeve; the production logging tools is now free to go up and down recording the required data to characterize the formation and effluents.

A proposed alternate solution to logging wells that will not flow on its own is described in United Kingdom Patent Application No. GB2383357 filed on Dec. 17, 2002, entitled "A system and method for logging and modifying the flow of downhole fluids" by Peter Schrenkel et al. wherein an artificial lift mechanism is lowered into the wellbore together with a production logging tool and a retrievable fluid barrier. These components are lowered at the same time with the production logging tool "housed" inside a protective sleeve. The aim is to plug a segment of the wellbore, characterize the formation and effluents for that perforated interval and then retrieve the fluid barrier. The wireline cable is passed from the inside of the protective sleeve to the outside and the wireline cable and the means used to lower the inventive apparatus are lowered into the wellbore at the same time. Once the retrievable fluid barrier is set in place, the production logging tool is free to move up or down in order to characterize the formation and effluents. Once the required information is collected the production logging tool is returned to the protective sleeve and the retrievable fluid barrier is retrieved to be repositioned and the process started again as needed.

It is an object of the present application to provide an improved apparatus and method for characterizing well effluents and a method for treating a well that avoids one or more of the problems with prior art apparatus and methods and/or provides one or more benefits over prior art apparatus and methods.

SUMMARY OF PREFERRED EMBODIMENTS

The following embodiments provide examples that do not restrict the breath of the disclosure and will describe ways to acquire information from a well that is unable to flow sufficient volumes of fluids in order to be characterized properly by itself without the use of an artificial lift mechanism along with a method to treat such wells.

An apparatus for characterizing well effluents including coiled tubing, an artificial lift mechanism operatively attached to the coiled tubing and a logging tool fitted with a multitude of sensors capable of characterizing well effluents associated with operation of the artificial lift mechanism. The artificial lift mechanism may be a downhole pump, an electric submersible pump, a gas lift system or similar technologies. The downhole pump may be attached to the downhole end of the coiled tubing and is used to flow the well's effluents.

A related embodiment of the apparatus for characterizing well effluents as described above may be that the logging tool fitted with a multitude of sensors is a production logging tool. The logging tool may be able to move up and down independently from the coiled tubing. Sensors in the logging tool may include sensors to evaluate the formation along with the effluents.

Also a method for characterizing well effluents that includes lowering a logging tool fitted with a multitude of sensors capable of characterizing well effluents with a cable and lowering an artificial lift mechanism on coiled tubing capable of flowing well effluent past the logging tool. The logging tool fitted with a multitude of sensors is preferably able to move up and down independently of the coiled tubing. The logging tool may be a production logging tool.

In a related embodiment of the method for characterizing well effluents as described above, the artificial lift mechanism may be a downhole pump, an electrical submersible pump, a gas lift system or similar technology.

In another related method for characterizing well effluents as disclosed above the artificial lift mechanism is used to produce the well's effluents while the logging tool characterizes the well effluents by moving up and down independently from the coiled tubing.

Further a method for treating a well including the steps of: characterizing well effluents by lowering a logging tool fitted with a multitude of sensors capable of characterizing well effluents on a cable and lowering an artificial lift mechanism on coiled tubing capable of flowing well effluent past the logging tool; and injecting a treatment into a desired formation selected using information obtained while characterizing the well effluents.

Also a related method for treating a well including the steps of: characterizing well effluents by lowering a logging tool fitted with a multitude of sensors capable of characterizing well effluents on a cable and lowering an artificial lift mechanism on coiled tubing capable of flowing well effluent past the logging tool, injecting a treatment into a desired formation selected use of information obtained while characterizing the well effluents; and further characterizing well effluents using the logging tool and the artificial lift mechanism.

Further features and advantages of the disclosure will become more readily apparent from the following detailed description when taken in conjunction with the accompanying drawings.

DETAIL DESCRIPTION OF THE PREFERRED EMBODIMENTS

Figure 1:
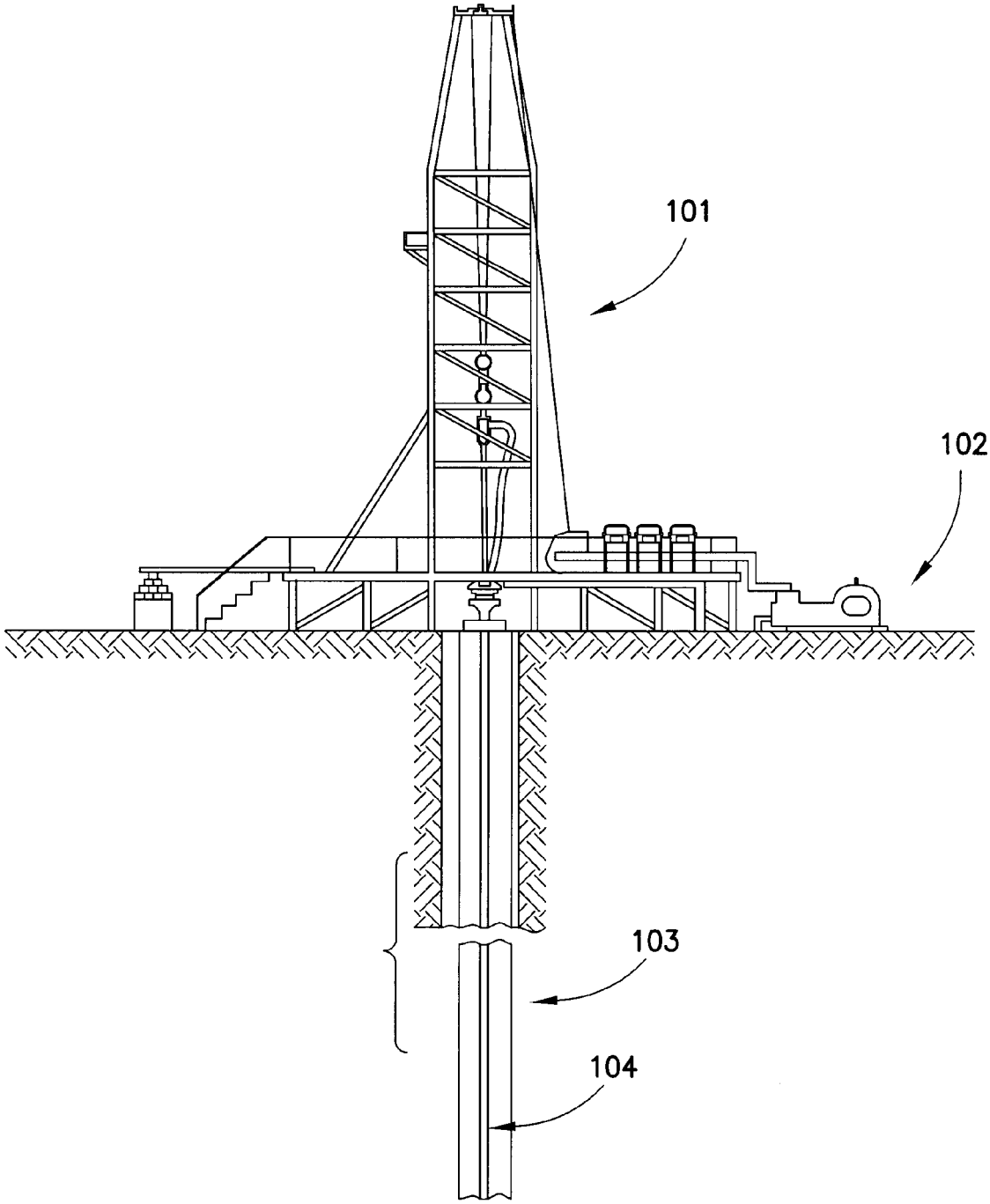
FIG. 1 shows a drilling rig.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The aim of the present embodiments is to supply the industry with an efficient and cost effective way to evaluate producing wells that have a production rate of effluents that is insufficient for collecting meaningful production logging information. Such wells may be able to flow at low rates or not flow at all without the use of an artificial lift mechanism. As discussed above there are a large number of producing wells that are in need of evaluation to correct deficiencies or increase production. The following disclosed embodiments describe apparatus and methods for performing such operations.

One preferred embodiment includes the use of coiled tubing to lower an artificial lift mechanism down into a wellbore of a well that will not flow in sufficient volumes to be evaluated via a conventional logging tool operation. The disclosed embodiments use novel approaches to enable the logging tools to be independently operated from the coiled tubing and the artificial lift mechanism. The artificial lift mechanism provides the required flow of effluents from the subsurface formation strata needed for evaluation and the coiled tubing acts as a safe conduit to transport the well's effluents to the surface.

A related embodiment of the methodology involves rigging up a logging tool at the surface with cable, wireline cable, slick line or similar, and lowering the logging tool to a desired depth; at this time the artificial lift mechanism to be used is deployed in the borehole using coiled tubing; the artificial lift mechanism is lowered to the preferred depth and the surface equipment and pressure gear for the logging cable, coiled tubing and related equipment to operate the artificial lift and to receive the effluents at the surface is now set up; once the surface equipment has been checked and operationally tested, the artificial lift mechanism is started in order to flow the well's effluents; the logging tool records the information required to evaluate the subsurface formation; once the acquisition of enough data from the logging tool has been achieved, the artificial lift mechanism is stopped and the retrieved to surface via the coiled tubing. The logging tool may be retrieved together with the coiled tubing and artificial lift mechanism or after both the coiled tubing and artificial lift mechanism has been retrieved from the borehole.

As most artificial lift mechanisms allow a direct injection of treating fluids through it or via the annulus between the coiled tubing and the casing, treatment fluids to correct producing zones deficiencies can be injected into the desired subsurface formation strata at any time during the disclosed operation embodiments if needed. The disclosed apparatuses allow for a flexible use of its capabilities, for example once the logging tool, coiled tubing and artificial lift mechanism are in place, the logging tool can start acquiring data with the artificial lift mechanism still not active; a treatment fluid could be injected into the desired subsurface formation strata before or after the artificial lift mechanism is activated and the logging tool has acquired the required data; a second logging tool data acquisition session can be done after the treatment fluid has been injected into the subsurface formation strata, etc. A person skilled in the art will appreciated the flexibility apparatuses as the ones described herein will introduce into this type of operation.

FIG. 1 shows an example of a drilling rig 101 at surface 102, where a casing 103 and deployed coiled tubing 104 inside the casing can be seen.

FIG. 2 shows an example of a possible sequence of events for one of the proposed embodiments. A person skilled in the art will recognize the events described henceforth can be modified to suit different environments without departing from the scope of the invention. FIG. 2*a* shows a drilling rig 201 with a logging unit 202 that will be used to drive the cable and communicate with the logging tool 203 during the logging operation. As mentioned before, the cable could be a wired cable, a slickline cable or similar means to lower and retrieve a logging tool. FIG. 2*a* depicts the logging tools being lowered into the wellbore to a predetermined depth close to the perforated interval of interest 204.

Figure 2A:
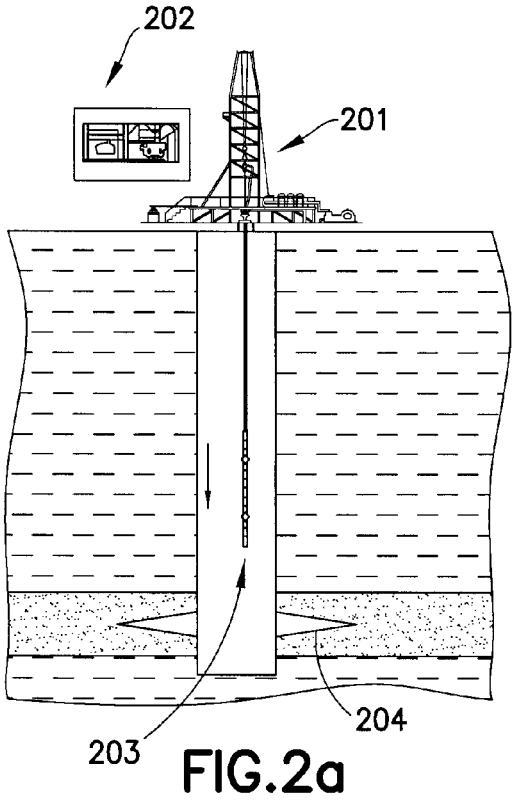
FIG. 2 shows a sequence of operations.
Figure 2B:
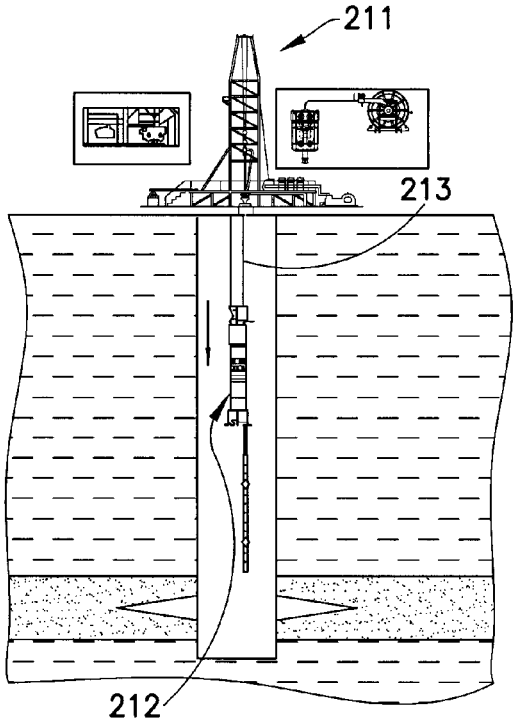

FIG. 2*b* shows a coiled tubing unit 211 set up at the surface and an artificial lift mechanism 212 being lowered into the wellbore to a predetermined depth. The surface equipment such as but not limited to, a Blowout Preventer, pressure gear, a coiled tubing injector head or similar types of devices, a wellhead stack, etc. are now rigged up, secured and function tested. Cable protector assemblies are deployed above and below the artificial lift mechanism 212 to protect the cable of the logging tools 203 from being damaged by the coiled tubing 213 or the artificial lift mechanism 212 while allowing for the independent operation of the logging tool 203 downhole. If the artificial lift mechanism 212 requires electrical power from surface, a downhole pump or an Electrical Submersible Pump, by way of example, the power cable is lowered together with the coiled tubing 213 as it enters the wellbore. The power cable may or may not be clamped to the coiled tubing 213 depending on the operation at hand. The cable for the logging tool 203 is preferably not clamped to the coiled tubing 213 at any time and it is free to move up or down.

Figure 2C:
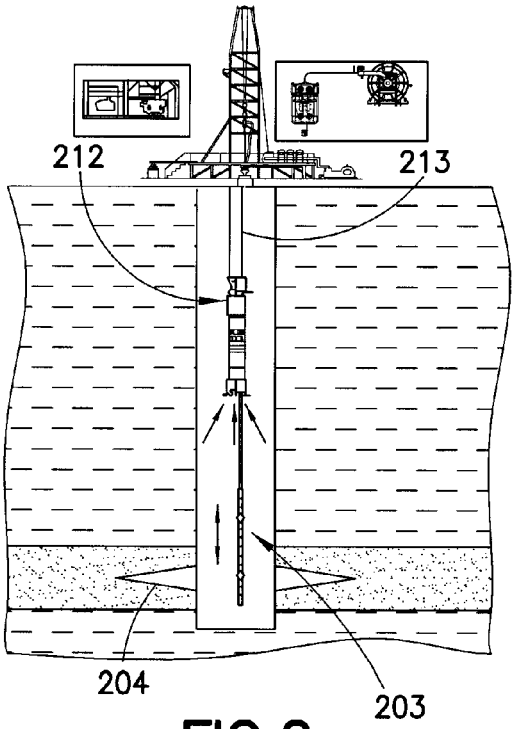
Figure 2D:
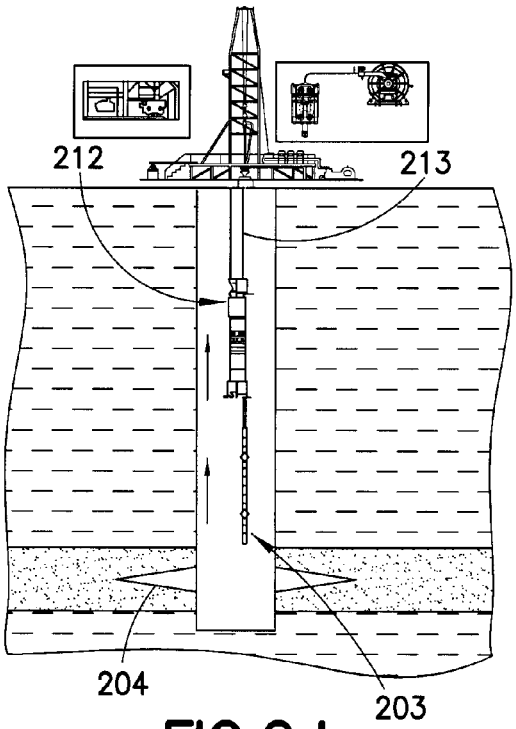

FIG. 2*c* shows the artificial lift mechanism 212 being activated and the logging tool 203 acquiring information. The flow of effluents from the subsurface formation strata 204 of interest is driven to surface by the artificial lift mechanism 212 and transported, in this particular example inside the coiled tubing 213; a person skilled in the art will recognize the effluents from the subsurface formation strata could also be transported to surface via the annulus between the coiled tubing and the casing by simply modifying the artificial lift configuration. Once the artificial lift mechanism 212 is activated the logging tool 203 is moved up or down as required to evaluate the subsurface formation strata 204. As the rates of the volume of effluents is controlled by the artificial lift mechanism and the artificial lift mechanism is itself controlled from surface, a person skilled in the art will recognize the advantage of being able to control the flow rates from the surface and design an evaluating program accordingly. FIG. 2*d* shows the final stage of the operation once the evaluation of the subsurface formation strata 204 of interest is finalized; the coiled tubing 213 with the artificial lift mechanism 212 can be retrieved from the borehole. The logging tool 203 can be retrieved from the borehole together with the coiled tubing 213 or once the coiled tubing 213 has reached surface.

Figure 3:
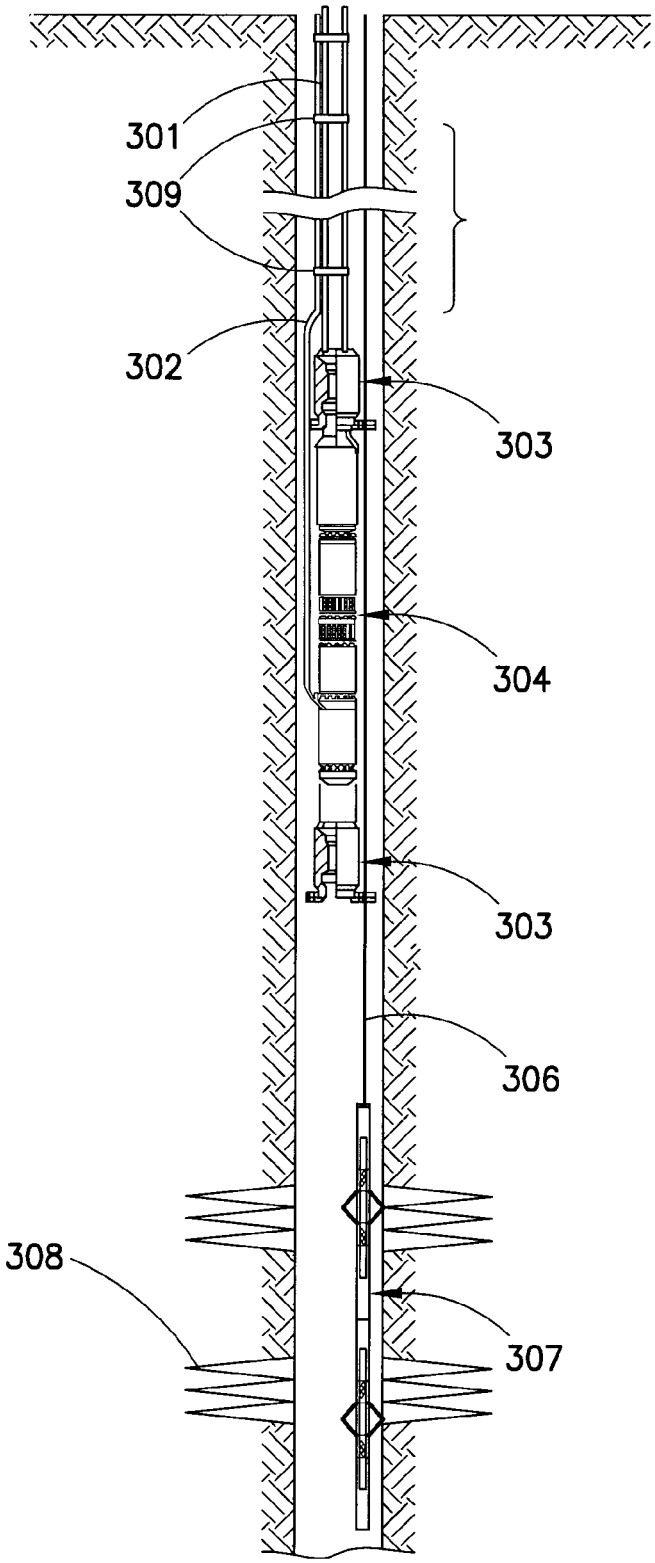
FIG. 3 shows a downhole system.

FIG. 3 shows a more detailed example embodiment of a possible downhole system, wherein the coiled tubing 301 is lowered into the borehole with the artificial lift mechanism 304 operatively attached to the end of the coiled tubing 301. If the artificial lift mechanism 304 requires the use of power from the surface (using electrical power or a nitrogen injection line for example) the power cable or line 302 may or may not be clamped to the outside of the coiled tubing 301 using coiled tubing clamps 309. The logging tool 307 is lowered independently from the coiled tubing 301 via a cable 306 before the coiled tubing 301 is deployed into the wellbore. The cable 306 of the logging tool is fed through the cable protector assembly 303 at surface after the logging tool 307 is lowered into the borehole and its primary function is to protect the cable from being damaged by the coiled tubing 301 or the artificial lift mechanism 304 while allowing the logging tool 307 to freely move up or down as needed to evaluate the subsurface formation strata 308 and its effluents.

Figure 4:
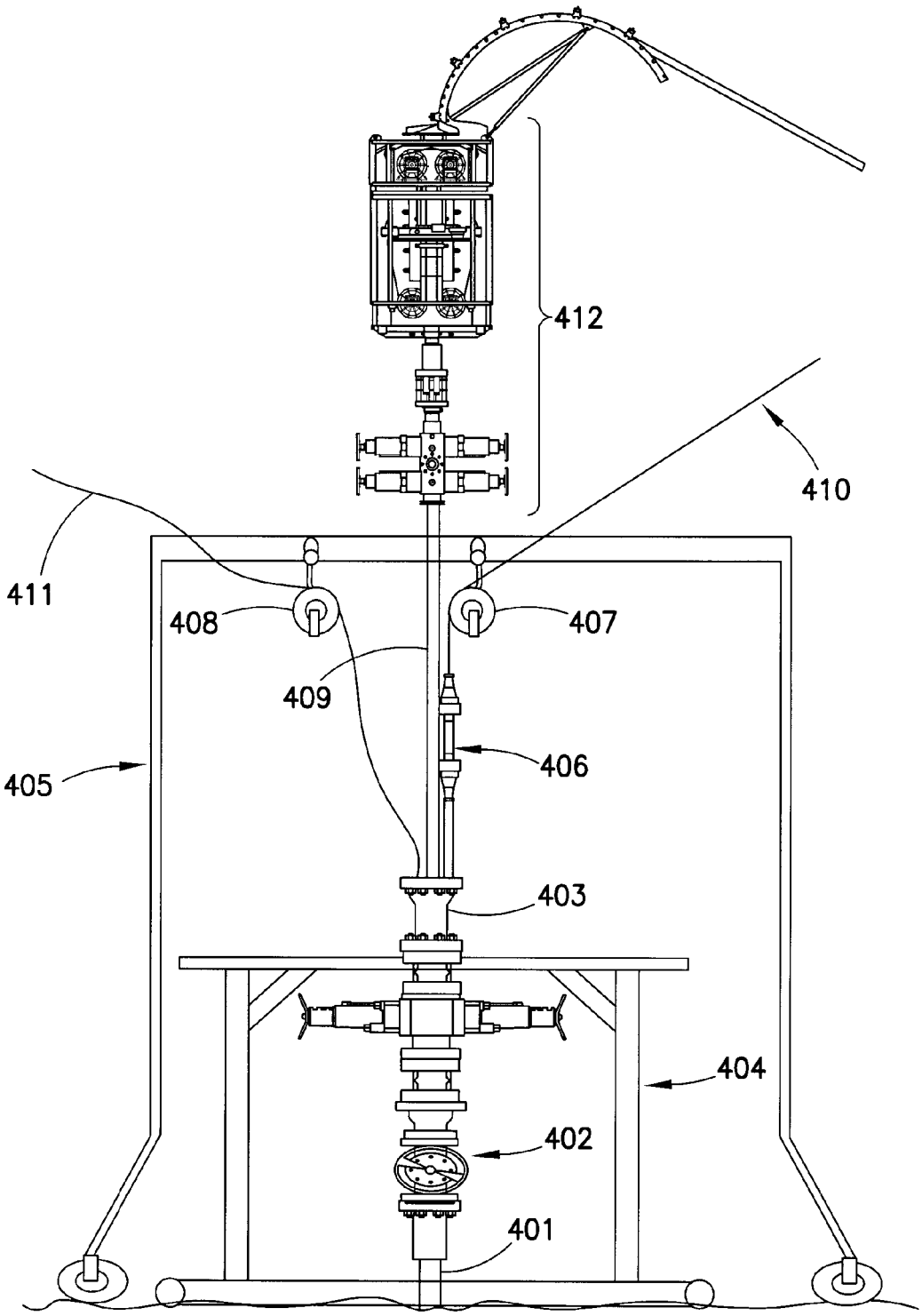
FIG. 4 shows surface equipment.

FIG. 4 shows an example embodiment of what the surface equipment may look like for an operation as described herein. It is to be understood that other alternative embodiments may be utilized and structural changes may be made without departing from the scope of the invention. The wellhead stack 402 is rigged up on top of the casing 401 and secured with a wellhead support frame 404. A wellhead 403 able to accept coiled tubing and a logging tool cable is rigged up on top of the wellhead stack 402. A person skilled in the art will recognize the multiple options for such wellhead 403 available in the industry, one such a wellhead 403 might be a modified Hercules wellhead or similar. Logging cable wellhead equipment 406 is rigged up on top of the wellhead to ensure pressure integrity during the operation, the logging cable 410 is aligned to the logging unit using a logging cable sheave 407. When a power cable or injection line 411 is required for the operation, it is aligned to the spool using a sheave 408. The power cable or injection line 411 is lowered into the borehole together with the coiled tubing 409. A support frame 405 is used to secure the sheave 408 for the power cable or injection line 411, the logging cable sheave 407 and the coiled tubing surface equipment 412.

Figure 5:
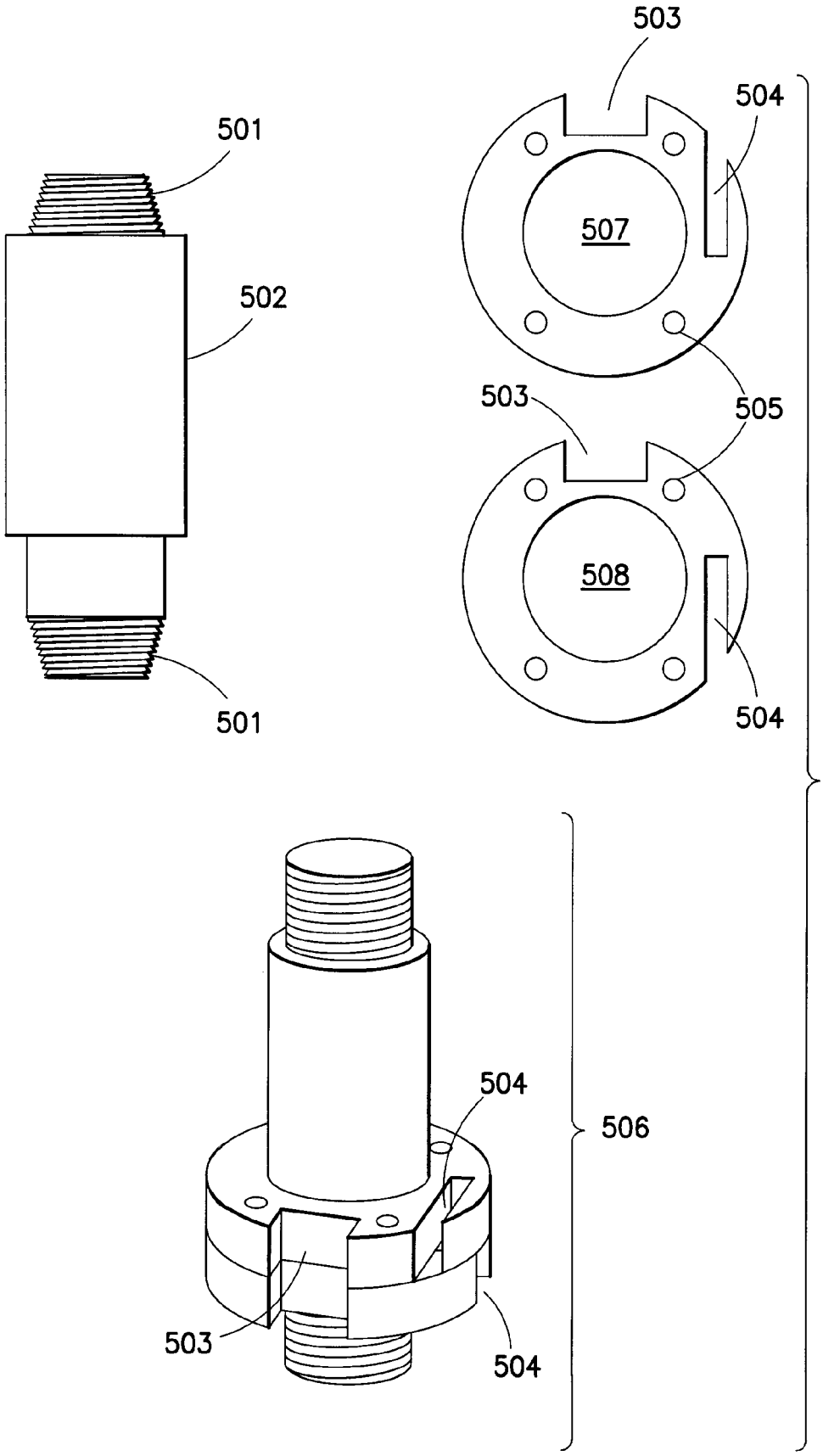
FIG. 5 shows a cable protector assembly.

FIG. 5 shows an example of an assembly used to protect the logging tool cable and the artificial lift mechanism power cable or injection line. These Figures illustrate a particular way to achieve the protection of the cables and a person skilled in the art will recognize the design may take different forms without leaving the scope of the invention. The exemplary cable protector assembly 506 shown in FIG. 5 consists of a cable protector sub 502 with a top and bottom threaded ends 501 coupled with two cable protector plates 507-508 similarly designed but with counter facing logging cable grooves 504 and a groove for the artificial lift mechanism power cable or injection line 503; the groves are designed to protect both cables from being damaged by the artificial lift mechanism or the coiled tubing. The shown embodiment suggests the use of at least two cable protector assemblies 506, one on the top and one on the bottom of the artificial lift mechanism. To set up the shown example of a cable protector assembly 506, the top cable protector plate 507 is placed in the cable protector sub 502, the logging cable is inserted in the logging cable groove 504 and the bottom cable protector plate 508 is placed so the logging cable groove 504 is facing in the opposite direction of the top cable protector plate's 507 logging cable groove 504. The bottom cable protector plate 507 is turned so the logging cable is in the logging cable protector groove 504 and the screw holes 505 are aligned. Then a set of screws are placed in the screw holes 505 and the cable protector plates (507 and 508) are secured to each other; the cable protector assembly is now ready to be operatively connected to the artificial lift mechanism. This disclosed exemplary embodiment of the cable protector assembly shows the logging cable housed in the logging cable groove 504 while being able to move up or down as required; the cable is protected from damage by the cable protector plates. The artificial lift mechanism power cable or injection line is protected by placing it on the power cable or injection line groove 503. If the power cable or injection line is used then it may or may not be clamped to the outside of the coiled tubing.

Information obtained while characterizing the well effluents and formation strata as described above may be used to select a well treatment fluid that may be used to remediate one or more problems associated with a particular downhole formation. As will be known to those skilled in the art, the well treatment fluid may consist for instance of acidizing fluids, scale removal fluids, fracturing fluids (with or without proppant), asphaltene deposit removal fluids, etc.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present disclosures, the description taken with the drawings making apparent to those skilled in the art how the several forms of the present invention may be embodied in practice. Further, like reference numbers and designations in the various drawings indicated like elements.

While the invention is described through the above exemplary embodiments, it will be understood by those of ordinary skill in the art that modification to and variation of the illustrated embodiments may be made without departing from the inventive concepts herein disclosed. Accordingly, the invention should not be viewed as limited except by the scope of the appended claims.

The invention claimed is:

1. A method for treating a well comprising the steps of:

lowering a logging tool on a cable into the well, the logging tool fitted with a plurality of sensors capable of characterizing well effluents;

characterizing well effluents by utilizing the sensors on the logging tool;

subsequently lowering an artificial lift mechanism on coiled tubing disposed external to the cable of the logging tool, wherein the cable of the logging tool is unenclosed by the coiled tubing, wherein the coiled tubing is capable of flowing well effluent past said logging tool, wherein lowering the logging tool and lowering the artificial lift mechanism occurs independent of the other, wherein the artificial lift mechanism and the coiled tubing are not affixed to the well while flowing well effluent past the logging tool;

obtaining information from characterizing the well effluents;

selecting a treatment based on the obtained information;

injecting a treatment into a desired formation utilizing the artificial lift mechanism; and further characterizing well effluents using the logging tool and the artificial lift mechanism.

2. A method for characterizing well effluents as in claim 1 wherein injecting the treatment comprises injecting a treatment fluid via the coiled tubing and the artificial lift mechanism.

3. A method for treating a well comprising:

lowering a logging tool into the well on a cable, the logging tool comprising a plurality of sensors capable of characterizing well effluents;

lowering an artificial lift mechanism into the well on coiled tubing disposed external to the cable of the logging tool, wherein the cable of the logging tool is unenclosed by the coiled tubing and the artificial lift mechanism is configured to flow well effluent past the logging tool, wherein lowering the logging tool may be performed prior to lowering the artificial lift mechanism;

operating the artificial lift mechanism to flow well effluent past the logging tool, wherein the artificial lift mechanism and the coiled tubing are not affixed to the well while operating;

characterizing well effluents with the logging tool;

obtaining information from characterizing the well effluents;

selecting a treatment and a well treatment fluid based on the obtained information;

injecting the well treatment fluid into a desired formation;

removing the artificial lift mechanism from the well; and removing the logging tool from the well.

4. A method for characterizing well effluents as in claim 3 wherein injecting comprises injecting the well treatment fluid utilizing the artificial lift mechanism and the coiled tubing.

5. A method for characterizing well effluents as in claim 3 wherein injecting occurs at a one of prior to flowing well effluent past the logging tool and after flowing well effluent past the logging tool.

6. A method for treating as in claim 3 wherein injecting comprises injecting a well treatment fluid comprising at least one of an acidizing fluid, a scale removal fluid, a fracturing fluids with proppant, a fracturing fluid without proppant, and an asphaltene deposit removal fluid.

7. A method for characterizing well effluents as in claim 3 wherein lowering the logging tool may be performed subsequent to lowering the artificial lift mechanism.

8. A method for evaluating at least one well formation, comprising:

providing a logging tool and artificial lift mechanism configured to operated independently of the other;

designing an evaluating program with the logging tool and the artificial lift mechanism;

lowering the logging tool into a well on a cable, the logging tool fitted with a plurality of sensors capable of characterizing well effluents;

lowering the artificial lift mechanism into the well on coiled tubing independent from the logging tool to dispose the artificial lift mechanism generally in-line with the coiled tubing;

operating the artificial lift mechanism to flow well effluent past the logging tool according to the evaluating program, wherein lowering the logging tool may be performed prior to lowering the artificial lift mechanism, wherein the artificial lift mechanism and the coiled tubing are not affixed to the well while operating;

evaluating a subsurface formation by obtaining information from characterizing the well effluents with the logging tool; and utilizing the information to select a subsequent treatment for the formation.

9. A method for characterizing well effluents as in claim 8 wherein the logging tool is able to move up and down independently of and generally parallel to the coiled tubing.

10. A method for characterizing well effluents as in claim 8 wherein the coiled tubing is able to move up and down independently of and generally parallel to the logging tool.

11. A method for characterizing well effluents as in claim 8 wherein said artificial lift mechanism comprises a downhole pump, an electrical submersible pump or a gas lift system.

12. A method for characterizing well effluents as in claim 8 wherein the artificial lift mechanism is used to produce the well's effluents while the logging tool characterizes the well effluents by moving up and down independently from the coiled tubing.

13. A method for characterizing well effluents as in claim 8 comprising:

disposing the cable within counter facing grooves of cable protector plates of a cable protector assembly; and connecting the cable protector assembly to the artificial lift mechanism.

14. A method for characterizing well effluents as in claim 8 wherein lowering the logging tool may be performed may be performed subsequent to lowering the artificial lift mechanism.

15. An apparatus for characterizing well effluents comprising:

a coiled tubing system deployable into and retrievable from a well, the coiled tubing system deployable and retrievable with coiled tubing surface equipment;

an artificial lift mechanism operatively attached to and disposed generally in-line with the coiled tubing, the artificial lift mechanism operable to be deployed into and moved within the well by the coiled tubing, the artificial lift mechanism and coiled tubing system each configured not to be affixed to the well while operating;

a logging tool fitted with a plurality of sensors capable of characterizing well effluents associated with operation of said artificial lift mechanism; and a wellhead configured to accept coiled tubing and a logging cable attached to the logging tool for deployment and retrieval thereof, wherein each of the logging tool and the coiled tubing are configured to move up and down in the well independently of the other, the logging tool arranged parallel to but distinct from the coiled tubing system and the artificial lift mechanism and operable to be deployed into the wellbore prior to the coiled tubing system and artificial lift mechanism.

16. An apparatus for characterizing well effluents as in claim 15 wherein the artificial lift mechanism comprises a downhole pump.

17. An apparatus for characterizing well effluents as in claim 16 wherein the coiled tubing system has a downhole end and wherein the downhole pump is attached to the downhole end of the coiled tubing and is used to flow well effluents past the logging tool.

18. An apparatus for characterizing well effluents as in claim 15 wherein the artificial lift mechanism comprises an electric submersible pump.

19. An apparatus for characterizing well effluents as in claim 15 wherein the logging tool is deployed on a cable extending completely external to the coiled tubing system and artificial lift mechanism.

20. An apparatus for characterizing well effluents as in claim 15, wherein the artificial lift mechanism utilizes a power cable for operation thereof, the power cable secured to the coiled tubing system via at least one coiled tubing clamp.

21. An apparatus for characterizing well effluents as in claim 15 wherein the logging tool is deployed into the well on a cable completely external to the coiled tubing and artificial lift mechanism and further comprising at least one cable protector assembly comprising a plurality of cable protector plates configured to protect a power cable of the artificial lift mechanism and the cable of the logging tool.

22. An apparatus for characterizing well effluents as in claim 21 wherein the plurality of cable protector plates comprise a pair of cable protector plates having counter facing grooves for receiving the cable of the logging tool.

23. An apparatus for characterizing well effluents as in claim 14 wherein the logging tool is operable to be deployed into the wellbore subsequent to the coiled tubing system and artificial lift mechanism.

* * * * *